US008337317B2

(12) United States Patent
Crawford et al.

(10) Patent No.: US 8,337,317 B2
(45) Date of Patent: Dec. 25, 2012

(54) FREE SWING FERRIS WHEEL

(75) Inventors: David W. Crawford, Long Beach, CA (US); Edward A. Nemeth, Hermosa Beach, CA (US)

(73) Assignee: Disney Enterprises, Inc., Burbank, CA (US)

( * ) Notice: Subject to any disclaimer, the term of this patent is extended or adjusted under 35 U.S.C. 154(b) by 314 days.

(21) Appl. No.: 12/883,834

(22) Filed: Sep. 16, 2010

(65) Prior Publication Data

US 2012/0071251 A1 Mar. 22, 2012

(51) Int. Cl.
*A63G 27/02* (2006.01)
*A63G 27/00* (2006.01)

(52) U.S. Cl. ..... 472/45; 472/46

(58) Field of Classification Search ..... 472/3, 30, 472/39, 45, 46; 104/53, 77
See application file for complete search history.

(56) References Cited

U.S. PATENT DOCUMENTS

| | | | | |
|---|---|---|---|---|
| 900,820 | A | 10/1908 | Becker | |
| 1,539,094 | A | 5/1925 | Miller | |
| 1,555,488 | A * | 9/1925 | Siebert | 472/45 |
| 1,568,424 | A | 1/1926 | Smith | |
| 1,583,567 | A | 5/1926 | Becker | |
| 1,737,032 | A * | 11/1929 | Sellner | 104/77 |
| 2,203,971 | A | 6/1940 | Shepherd | |
| 2,828,128 | A | 3/1958 | Castille | |
| 2,864,614 | A | 12/1958 | Castille | |
| 3,226,113 | A * | 12/1965 | Mercer et al. | 472/3 |
| 3,529,816 | A * | 9/1970 | Barber | 472/3 |
| 4,815,728 | A | 3/1989 | O'Keefe | |

FOREIGN PATENT DOCUMENTS

| | | | |
|---|---|---|---|
| JP | 2000070554 | A | 3/2000 |
| JP | 2007105353 | A | 4/2007 |

* cited by examiner

*Primary Examiner* — Kien Nguyen
(74) *Attorney, Agent, or Firm* — Marsh Fischmann & Breyfogle, LLP; Kent A. Lembke

(57) ABSTRACT

A Ferris wheel-type ride. A lever arm is mounted to the wheel rim to freely pivot between front and rear stops. Passenger gondolas, pivotally attached to the lever arms, travel through four zones experiencing differing ride dynamics. In the first zone, the lever arm abuts the front stop while, in the second, the lever arm is spaced apart from the stops and the lever arm is supported from above by the wheel via the lever arm causing the gondola to be vertically lifted and to rotate slower than the hub rotation rate. In the third zone, the lever arm abuts the rear stop and, in the fourth zone, the lever arm is spaced apart from the stops and is supported from below by the wheel as it falls toward the front stop at a rate greater than the hub rotation rate.

18 Claims, 7 Drawing Sheets

FREE SWING FERRIS WHEEL

BACKGROUND

1. Field of the Description

The present description relates, in general, to amusement and theme park rides, and, more particularly, to a new Ferris wheel (or rotating wheel, observation wheel, big wheel, or the like) ride that provides additional, varied, and, in some cases, user-controlled vehicle movements relative to a central rotating wheel or hub.

2. Relevant Background

Amusement and theme parks are popular worldwide with hundreds of millions of people visiting the parks each year. Park operators continuously seek new designs for rides that attract and continue to entertain guests. Many rides have been utilized for many years with the only changes being cosmetic such as changing theme elements (e.g., to have images and vehicles from a popular movie, television show, or video game) or vehicle designs. Such cosmetic changes do not change the ride experience to any degree as the vehicle moves in the same way, at the same speeds (or ranges of speeds), and over the same predictable path.

For example, while still popular, Ferris wheels have provided substantially the same, predictable experience for over one hundred years. The traditional Ferris wheel, which also may be known as a rotating wheel, observation wheel, big wheel, or other names, includes a rotating upright (or vertical) wheel with passenger cars (or gondolas, capsules, or the like) attached to the rim. By "upright" or vertical, it is meant that the rotating wheel or hub rotates about a central axis that is above and parallel to the ground plane or load/unload platform similar to a typical bicycle wheel. The vehicles are attached to the rim of the wheel such that as the wheel turns the cars are kept upright. Typically, the passenger car is free to swing via a direct pivotal connection to the rim, with gravity acting on the slightly swinging vehicle to keep the passenger vehicle in a lower, upright position. In some of the largest and most modern Ferris wheels or observation wheels, the vehicles or cars are mounted on the outside of the rim with electric motors independently rotating each car to keep it upright (e.g., motorized capsules such as The London Eye's passenger capsules).

Attempts to enhance or change the experience or thrill of the Ferris wheel have typically been limited to increasing the size of the wheel to increase the elevations at the top of the wheel's rotation and, in some cases, to change the shape of the wheel. These have not met all the needs or goals of park operators. Hence, there remains a need for new and thrilling rides that maintain the simplicity and major elements of a traditional park ride such as the Ferris wheel. In this way, a small footprint ride may be provided with simple control aspects, low development costs, and reasonable maintenance requirements while increasing the excitement and variability of the ride so as to attract repeat riders in direct contrast to the predictability and tameness of a conventional Ferris wheel.

SUMMARY

The present description is generally directed toward a new rotating wheel ride (or free-swinging Ferris wheel, free-fall Ferris wheel ride system, or the like). In the rotating wheel ride, portions of a conventional Ferris wheel may be used to provide a wheel or hub that is supported upon a frame or support structure to be positioned vertically and to be rotated at a constant speed about its center axis (i.e., the hub's center axis is spaced apart and parallel to the ground plane or a foundation for the frame). The rotating wheel ride is configured to provide a variety of new and interesting vehicle/gondola dynamics throughout the course of each revolution of the wheel or hub.

For example, each rotation provides four vehicle dynamic zones that provide varied movement sensations and also vehicle velocities including zones where the vehicle rotates with the hub, a zone where the vehicle is allowed to free fall and move faster than the hub, and a zone where the vehicle is vertically lifted and moves slower than the hub. In some embodiments, the passenger vehicles are attached to a rim of the center hub with pivot or lever arms (or a single pivot/lever arm). The passenger vehicles are free to swing at the outer end of the lever arms, and the lever arms themselves are pivotally mounted at a second or inner end to the hub (or its rim).

The rim is specially designed to provide an interface that provides a front stop and also a back stop for each vehicle's lever arms (e.g., the lever arms are pivotally mounted to the rim between a pair of stops). Due to the contact surface of the rim and the pivotal mounting via a pair of lever arms (in this embodiment), the lever arms and the attached/corresponding vehicle rotate between the front and back stops as the hub or wheel turns or rotates about its axis. The dynamics of the ride experience are highly adjustable to provide everything from a family friendly ride to a high thrill ride (e.g., by adjusting the angular separation or spacing between the stops to reduce or increase the range of travel during the free fall, by changing the length of the lever arms, by dampening or throttling the maximum allowable rate of pivoting free fall of the lever arms, by allowing vehicle passengers to operate a braking mechanism that may slow rotation of the lever arms, and so on). The use of the lever arms that are pivotally mounted to the rim to support the passenger vehicles allows the vehicles to be substantially vertically lifted upward while not in contact with the stops (e.g., when hanging from a lower portion of the wheel) and later to be dropped vertically downward while not in contact with the stops (e.g., when supported from the rim/lever arm connection from below when the vehicle is at the top of the wheel's rotation).

More particularly, a rotating wheel ride is provided that includes a vertical wheel driven to rotate about a central rotation axis. The ride further includes a plurality of passenger vehicles; and, more interestingly, a lever arm assembly associated with each of the passenger vehicles. The lever arm assembly is pivotally connected at a first end to the wheel and at a second end to the associated passenger vehicle. In some embodiments, the wheel includes, for each of the passenger vehicles, a front stop and a rear stop spaced apart from the front stop. Each of the lever arm assemblies may be positioned on the wheel to pivot during a rotation of the vertical wheel between a first contact with the front stop to a second contact with the rear stop.

In one representative embodiment of the rotating wheel ride, each of the lever arm assemblies includes at least one lever arm pivotally coupled to the wheel and to the associated passenger vehicle. In this manner, the associated passenger vehicle is pivotally supported by the lever arm. Each of the lever arms may extend outward from the wheel between a pair of the front and rear stops to the associated passenger vehicle. For example, the wheel may include a rim with a contact surface providing the front and rear stops. In these embodiments, each pair of front and rear stops may be configured to define an angular travel range for one of the lever arms. In such cases, the contact surface may have a sawtooth pattern made up of adjacent ones of the front and rear hard stops configured such that the angular travel range is a value chosen from the range of about 15 degrees to about 110 degrees (e.g., 75 to 100 degrees or the like). Each of the lever arms may have a length measured between a pivotal connection on the wheel and a pivotal connection to the associated passenger vehicle that is at least about 8 feet (e.g., 10 to 15 feet or more in some embodiments to achieve a desired maximum vehicle velocity during free falling ride portions).

According to another aspect or embodiment of the description, a Ferris wheel-type ride is provided that includes a vertically orientated hub adapted for being rotated about a central axis and supporting a plurality of vehicles. The ride also includes a lever arm associated with each of the vehicles, and the lever arm is pivotally coupled to the hub at a first end and to the associated vehicle at a second end. This allows the lever arm to pivot at the first end and the associated vehicle to pivot about the second end during rotation of the hub about the central axis. The ride further includes, for each of the lever arms, a pair of stops defining a range of travel for the lever arm between a first and second stop as the lever arm pivots about the first end. In the ride, the range of travel is typically greater than about 15 degrees (such as 75 to 100 degrees or the like).

In some embodiments, the hub includes a rim providing a contact surface defining the stops, and each of the lever arms is pivotally connected to the rim between one of the pairs of stops. In these embodiments, each of the lever arms may be adapted to pivot between one of four positions during the rotation of hub. The four positions (or zones) may include: (1) a first zone position with the lever arm in contact with the first stop; (2) a second zone position with the lever arm spaced apart from the stops and the lever arm supported from above by the rim; (3) a third zone position with the lever arm in contact with the second stop; and (4) a fourth zone position with the lever arm spaced apart from the stops and the lever arm supported from below by the rim.

In the ride, in the fourth zone position, the lever arm free falls, under gravitation forces acting upon the lever arm and the associated vehicle, toward the first stop and in a direction of the rotation of the hub such that the associated vehicle moves at a velocity exceeding a rotation rate of the hub about the central axis. A second lever arm may be associated with each of the vehicles and be spaced apart from the other lever arm associated with the vehicle to pivot at a first end on the hub and to pivotally support the associated vehicle at a second end via a shaft extending to the second end of the other lever arm. With this design/arrangement, the associated vehicle is able to pivot between the lever arms during rotation of the hub about the central axis. In some embodiments, a passenger or user input device may be provided in each of the vehicles, and the ride may further include a brake mechanism for each lever arm braking the pivoting of the lever arm during rotation of the hub in response to input received from the user input device.

According to yet another aspect, a ride is described that includes a vertical wheel rotating at a hub rotation rate during operation of the ride. The ride includes pairs of spaced apart stops providing a contact surface for the wheel. A lever arm assembly is associated with each of the stop pairs and mounted to the wheel to pivot between a front stop and a rear stop in the associated stop pair during the operation of the ride. The ride also includes a passenger gondola pivotally attached to each of the lever arm assemblies at a location on the assembly that is spaced apart from the contact surface. In practice, each of the passenger gondolas sequentially travels through at least first and second vehicular dynamics zones in which the passenger gondolas have differing ride dynamics (e.g., differing travel velocities or rotation rates about the center axis). In the first vehicular dynamics zone, a portion of the lever arm assembly abuts the front stop while, in the second vehicular dynamics zone, the lever arm is spaced apart from the stops and the lever arm assembly is supported from above by the wheel via a pivotal connection mechanism.

Each of the passenger gondolas may further sequentially travel through at least third and fourth vehicular dynamics zones. In the third vehicular dynamics zone, a portion of the lever arm assembly abuts the rear stop. In the fourth vehicular dynamics zone, the lever arm assembly is spaced apart from the stops and the lever arm assembly is supported from below by the wheel on the pivotal connection mechanism. In such embodiments, the lever arm assemblies may be vertically supported by the front and rear stops, respectively, when the associated passenger gondola is in the first and third vehicular dynamics zones. In this manner, the passenger gondola associated with each of the lever arm assemblies has a velocity of about the hub rotation rate in the first and third vehicular dynamics zones (e.g., rotates with the hub).

In some embodiments, the lever arm assemblies pivot in a direction opposite of rotation of the wheel in the second vehicular dynamics zone. Hence, the passenger gondola associated with each of the lever arm assemblies has a velocity of less than the hub rotation rate and is vertically lifted in the second vehicular dynamics zone. Further, the lever arm assemblies may pivot in a direction coinciding with rotation of the wheel in the fourth vehicular dynamics zone (pivot in direction of hub rotation or fall or pitch forward and not backward in this zone). In this manner, the passenger gondola associated with each of the lever arm assemblies has a velocity greater than the hub rotation rate in the fourth vehicular dynamics zone.

DETAILED DESCRIPTION

Figure 1:
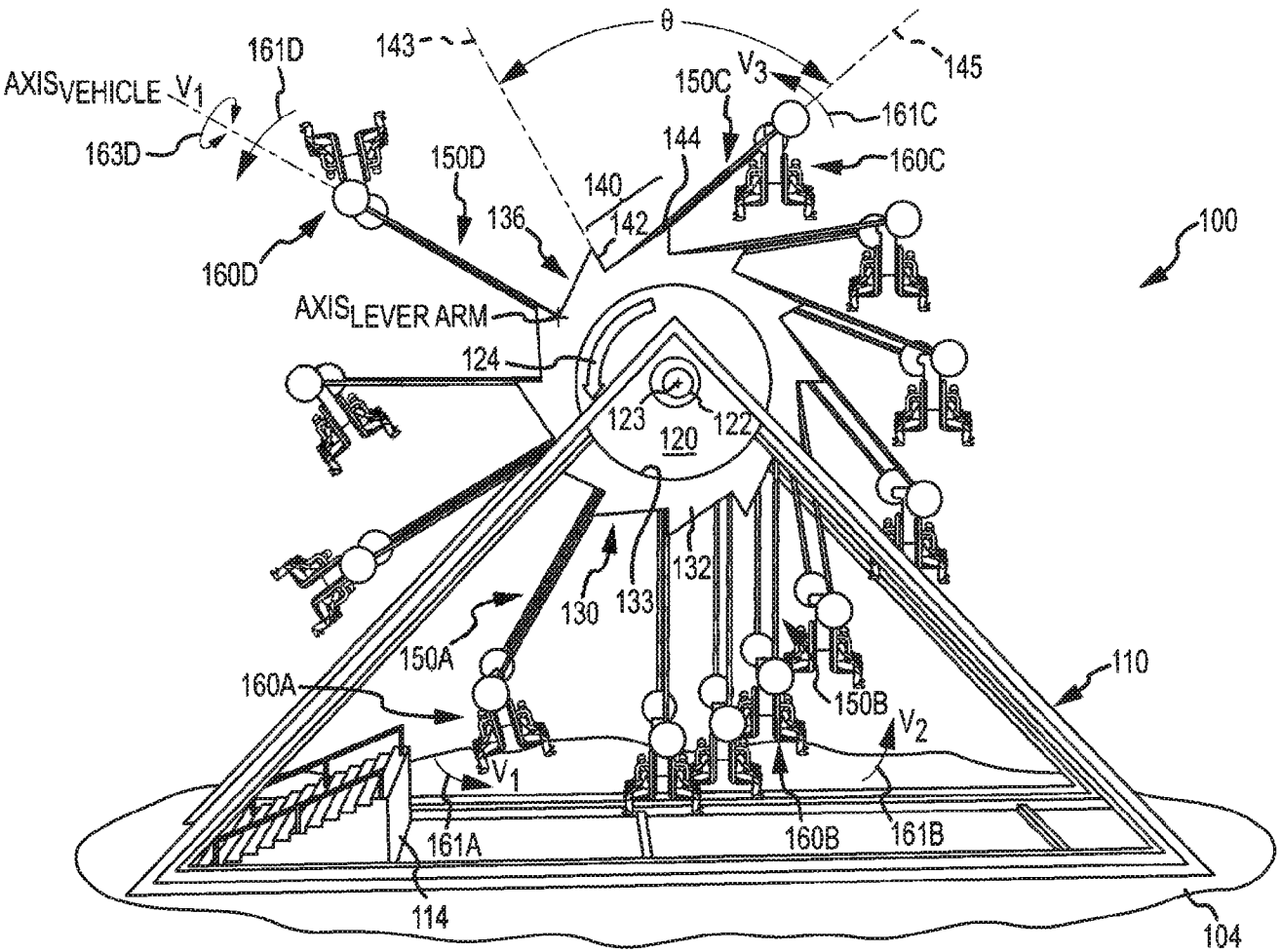
FIG. 1 is a side view of rotating wheel ride (or, more simply, a Ferris wheel or the like) according to one embodiment of the description illustrating use of a lever arm assembly to support passenger vehicles or gondolas in combination with a rim that provides a contact surface for the lever arm assemblies so as to provide pairs of front and back stops for each passenger vehicle pivotally mounted to the rim via the lever arm assembly.

The description is generally directed to a new Ferris wheel or rotating wheel ride that provides enhanced passenger thrill and varied ride dynamics during each rotation of a central hub or wheel. Briefly, the rotating wheel ride includes the vertical wheel or hub that is rotated about its central axis (as occurs with conventional Ferris wheels). A plurality of passenger vehicles or gondolas are attached or mounted to the hub in a unique manner by providing a rim for the hub that defines a contact surface with a pair of stops (front and back stops) for each gondola. Instead of directly attaching the gondola to the rim, a lever arm assembly is provided for each vehicle that includes one or more lever arms. The lever arms for each vehicle are pivotally attached to the rim (or hub) between a pair of the stops such that the lever arms may freely rotated between each stop for a range of free fall or free swinging travel (e.g., a range of travel that may be defined by angular travel or rotation about the pivot connection such as up to 90 degrees or more). The gondola is then pivotally attached to the lever arms such as at an end distal to the rim such that it can swing throughout rotation of the hub, By connecting the gondola to the end of a lever arm and allowing the lever arm to pivot through a limited range of motion, an extremely exciting, dramatically variable, and entirely new experience is achieved for passengers of the rotating wheel ride. While the rotating hub and its driving, support, and control/actuation components are the same or similar to that of a standard Ferris wheel, the unique configuration of the rim and the manner of attaching the gondola to the main hub creates a wide variety of dynamic experiences as the gondola is rotated around the center hub. Lever arm rotation or pivoting may, in some embodiments, be passive (or non-actuated), and the dynamics experienced by the gondola and its passengers would depend on the position of the gondola and its center of gravity (CG) as well as the spacing/location of the front and back stops and orientation of the gondola relative to the central axis of the hub (e.g., angular orientation of the gondola during each rotation that may be labeled as four differing lever arm-to-rim contact surface zones or differing vehicular dynamics zones). A wide degree of adjustability and even passenger control is available depending on the arrangement of the various equipment of the rotating wheel ride such as configuration/spacing of stops and length of lever arms.

The description below provides a Ferris wheel-type ride system that includes a swinging passenger seating structure that is attached to a vertical hub (which, during ride operations, typically rotates continuously at one or more rotation rates/speeds). Attachment is through a pivoting lever arm with limited rotation range such that the lever arm pivots within the rotational range defined by front and back stops depending on the following: (1) gravity vector and its effect on the vehicle's CG and (2) arm contact (or lack of such contact) with the stops.

Specifically, with regard to lever arm contact and its effects on vehicular dynamics, the pivot or lever arm(s) may be in contact with either the front stop or the back stop. In either case (e.g., Zones 1 and 3 in FIG. 7), the vehicle (or swinging passenger seating structure) rotates with the hub typically at the same (or substantially the same) rate as the main hub, and the ride experience and vehicular dynamics are similar to those found in a traditional Ferris wheel. When the CG of the vehicle (including the lever arm, seating structure, passengers, and other components pivotally supported on the hub rim between the stops) passes over the pivotal connection point of the lever arm to the hub (typically, this occurs near the top or uppermost position on the rim), the vehicle pivots about the pivotal connection point of the lever arm to the hub (or rim) in the same direction as hub rotation. The vehicle (and lever arm) rotates forward under the force of gravity (in a free falling, dampened, or passenger-initiated braked manner) to achieve a velocity that is greater than the hub rotation rate until the lever arm contacts the front stop at the forward end of the stop-defined range of travel for the lever arm (see, Zone 4 of FIG. 7). When the CG of the vehicle passes under the pivotal connection point of the lever arm to the hub (typically, this occurs near the lowest point on the rim), the vehicle pivots about the pivotal connection point of the lever arm to the hub/rim in the opposite direction as hub rotation such that the vehicle achieves a rotation rate that is less than the hub rotation rate (see, for example, Zone 2 of FIG. 7). In this zone of vehicular dynamics, the passengers of the vehicle may sense a vertical lifting sensation until the lever arm contacts the back stop at the rear end of the stop-defined range of travel for the lever arm.

Figure 2:
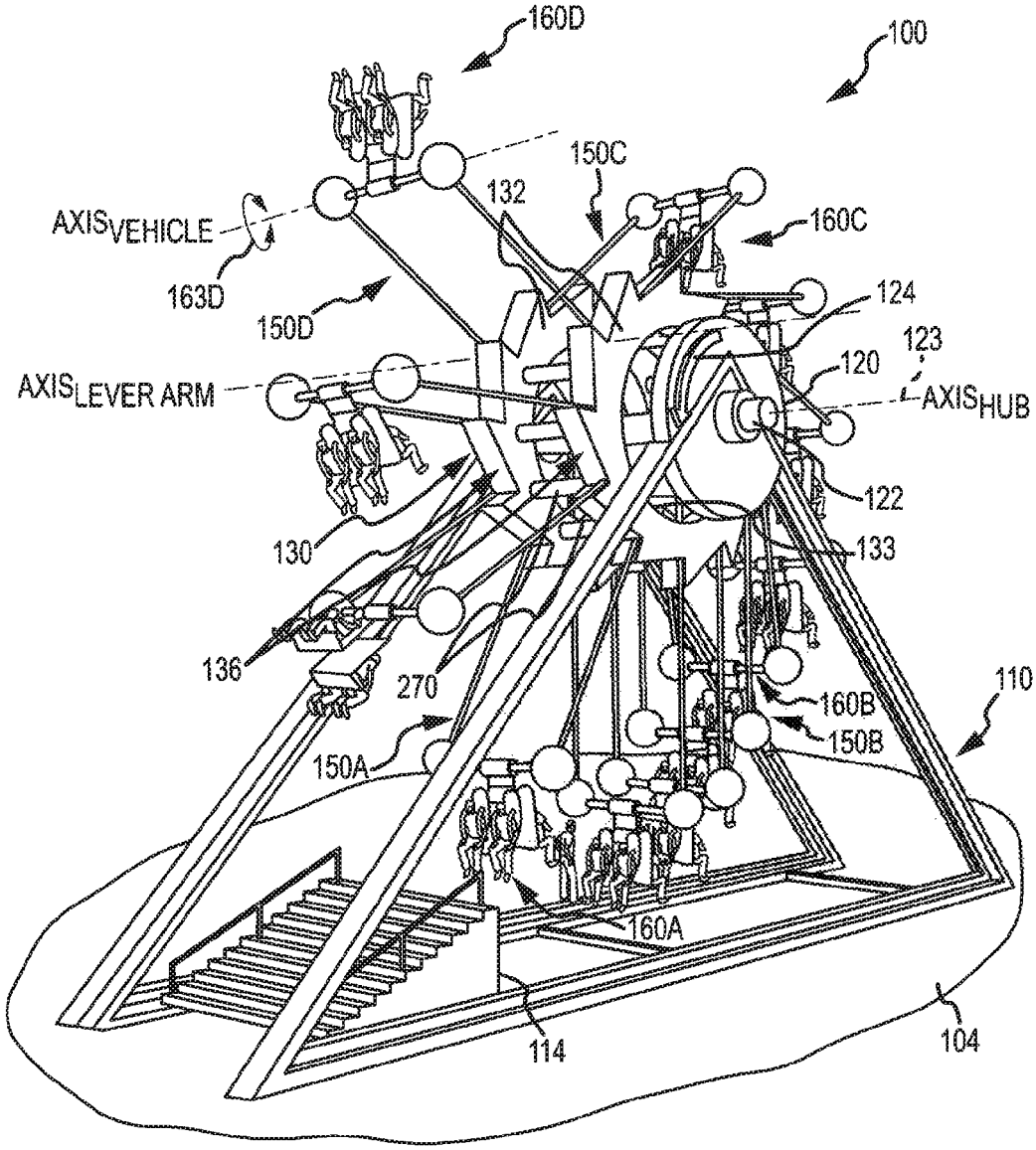
FIG. 2 is an end perspective view of the rotating wheel ride of FIG. 1.

FIGS. 1 and 2 illustrate a rotating wheel ride 100 useful for providing two or more vehicular dynamics (or passenger ride experiences) per rotation or ride cycle. The rotating wheel ride 100 includes a foundation or base 104 upon which a support frame or structure 110 is provided as well as a loading platform 114 to allow passengers to enter gondolas or passenger vehicles of the ride 100. The frame 110 is used to support a hub or wheel 120 that is configured to be actuated/driven so as to rotate as shown with arrow 124 at one or more rotation rates (e.g., many Ferris wheel rides continuously rotate at one rotation rate) about shaft/pin 122 or about center rotation axis 123. The hub 120 includes one or more motors, engines, or drives that allow it to be operated to rotate 124 about axis 123. The particular drive device (not shown for simplicity of illustration) used and the rotation rate for hub 120 achieved is not limiting to the invention, and this drive device may be any of a wide variety of devices used to rotate existing or yet to be developed Ferris wheel-type rides.

An important aspect of the rotating wheel ride 100 is how passenger vehicles are mounted and supported on the hub or wheel 120. To this end, the ride 100 further includes a rim 130 with a body 132 that is rigidly affixed to hub 120 to rotate 124 with the hub about axis 123. The body 132 may be a unitary body such as a cylindrical, truss, or tubular body or, as shown, the body 132 may be formed of two or more spaced apart plates or planar elements. The body 132 includes a contact surface 136 that is configured to define a range of travel of each lever arm of the ride 100.

To this end, the contact surface 136 may resemble a saw-tooth or other pattern to define a plurality of pairs of front and back stops, with each pair being associated with one vehicle and its lever arm(s). In other words, the number of pairs 140 of stops 142, 144 matches the number of lever arm assemblies/passenger vehicles. In FIGS. 1 and 2, a stop pair or assembly 140 is shown on rim contact surface 136, and the pair 140 includes a front stop 142 and a back stop 144. These stops may also be called or thought of as first and second stops or receiving and lifting stops (with the receiving stop 142 being at the front end of the stop-defined travel range and the lifting stop 144 being at the rear end of the stop-defined travel range).

The stop-defined travel range may be defined by an angle, θ, as measured between planes or axes extending outward from the huh center axis 123 along the contact surfaces provided by the stops 142, 144 as shown at 143, 145. The angle, θ, may vary widely to practice the ride 100 and so as to define an amount of free fall or free swinging of a lever arm assembly and its pivotally supported vehicle/gondola. The angle, θ, is shown to be in the range of 70 to 90 degrees but it will be understood that nearly any angle less than 70 degrees may be used and larger angles may also be used (especially when damping is provided to limit the rate of free fall of the lever arm). The front and back stops 142, 144 are shown to define a V-shaped valley and to meet/contact each other, but other configurations of stops will be readily apparent to those skilled in the art including stops that are integral to the pivoting bearing. Note, too, that each stop 142, 144 is formed of two spaced apart portions/areas of the contact surface 136 of rim (e.g., "stop" is not limited to a single component/surface). Hence, the particular configuration is not limiting as long as each pair 140 of stops defines an amount, θ, of angular travel or rotation and provides spaced apart contact surfaces for a lever arm assembly to pivot or rotate between. Typically, the pattern of pair 140 is repeated about the surface 136 such that each stop pair is identical (with numbering not repeated in FIGS. 1 and 2 for ease of illustration), but this is not required to practice the invention (e.g., may be useful in some applications to have differing vehicles have differing ride experiences and vehicular dynamics (such as a range of "thrill" assigned to each vehicle)).

According to another important aspect of the invention, the ride 100 is configured such that each vehicle or gondola is pivotally mounted to the hub 120 (or rim 130) between a pair 140 of the stops 142, 144 via a lever arm (i.e., not simply pivotally mounted to a rim as with conventional Ferris wheels). To explain such a configuration and operation of the ride 100, it may be useful to discuss four such lever arm/vehicle combinations along with their positions relative to the hub 120 and their vehicular dynamics. The ride 100 includes a lever arm assembly 150A supporting a passenger vehicle 160A. The lever arm assemblies and vehicles are explained in more detail below with reference to FIG. 3, but, for now, it is adequate to understand that the lever arm assembly 150A includes a pair of lever arms that are pivotally attached to the rim body 132 such as at a first or inner end via an axle/shaft 270.

The lever arms of assembly 150A extend outward between two stops 142, 144 of a stop pair associated with or corresponding with vehicle assembly 160A such that when the pivot or lever arms of assembly 150A rotate about their pivotal connection they are free to swing from contacting either stop 142, 144 to the space between stops 142, 144 where the lever arms are free from contact (and the arm assembly 150A and vehicle 160A are supported only by the pivotal connection to be free swinging). As illustrated in FIGS. 1 and 2, the vehicle 160A has just left/passed the loading platform 114, and the CG of the vehicle 160A and arm assembly 150A has a relative orientation to the hub rotation axis 123 (e.g., not immediately above or below) and the stops 142, 144 are configured such that the arms of the assembly 150A are abutting or contacting the front or first stop 142 of the stop pair 140. As a result, the lever arm assembly 150A and vehicle 160A are rotated as shown with arrow 161A with the hub 120 in the same direction as the hub 120 and at a velocity, $V_1$, that is the same rate as for hub rotation 124. Hence, this may be thought of as a convention Ferris wheel ride experience for passengers of vehicle 160A.

However, the ride 100 also includes lever arm assembly 150B pivotally mounted at a first end to the rim body 132 between a pair 140 of stops 142, 144 and pivotally supporting at a second end a passenger vehicle 160B. The CG of the vehicle 160B (and lever arm 150B along with other contributors to CG such as passengers in vehicle 160B) has passed a point directly below the rotation axis 123 of the hub 120, and with the particular configuration of the front stop (e.g., axis 143 is coplanar with axis 123 or substantially so), the lever arms of assembly 150B no longer abut/contact the front stop 142 (and have not yet come into contact with the back stop 144 of stop pair 140 associated with or corresponding to vehicle 160B).

In this relative orientation to the hub 120, the pivot/lever arms of the assembly 150B are only pivotally supported from above at the first or inner ends of the arms by the rim body 132 (or hub 120, in some cases). In such an orientation, the lever arms of assembly 150B tend to rotate in response to gravity in a direction opposite and relative to the travel of rim 130 such that the vehicle is rotated as shown at arrow 161B in the direction of hub rotation 124 but at a slower velocity, $V_2$ (i.e., $V_2$ is less than $V_1$). For passengers of the vehicle 160B, the ride experience or vehicular dynamics differ from those of vehicle 160A as vehicle 160B is moving at a slower velocity and the support only from above generates a substantially vertical lifting sensation. Hence, the ride 100 provides two differing ride experiences with a single rotating hub 120 through the use of rim 130 with contact surface 136 providing pairs 140 of stops 142, 144 combined with the pivotally supported lever arm assemblies 150A, 150B used to attach the vehicle assemblies 160A, 160B to the rim 130 or main hub 120.

As the wheel/hub 120 rotates 124 further, the ride experience provided by rotating wheel ride 100 changes again. This can be seen with vehicle 160C pivotally supported at an outer end of lever arm assembly 150C. The lever arm assembly 150C again includes a pair of lever arms each with an outer end supporting the vehicle 160C and an inner end pivotally mounted to the rim body 132 such that the arms are free to pivot between stops 142, 144 of stop pair 140 (e.g., based on relative position of the CG of vehicle 160C and assembly 150C and other CG contributors to the rotation axis 123 of the hub 120). Based on the configuration of the back stop and relative location of the CG, the lever arms of assembly 150C come into contact with the rear stop 144 at a point in the rotation of hub 120. For example, if the stops 142, 144 are spaced apart by an angle, θ, of about 90 degrees, the arms of assembly 150C may come into abutting contact with rear stop 144 after about a quarter turn of the hub 120 about axis 123 from the point where the CG of vehicle 150C was directly below the rotation axis 123 (whereas an eighth of a turn may be required to bring about contact if the angular travel defined between stops 142, 144 is about 45 degrees and so on).

When the arms of lever arm assembly 150C contact the rear stop 144, the arms and pivotally supported vehicle 160C are rotated as shown with arrow 161C in the direction of rotation 124 of the hub 120 and at the same rate (e.g., $V_3$ equals $V_1$, which equals the hub rotation rate). In other words, the passengers of vehicle 160C again experience a Ferris wheel-type ride sensation of rotating about a vertical wheel. However, the ride experience is enhanced because the passengers begin to anticipate a change to a free fall or free swinging experience (or pitching sensation) that occurs as the vehicle 160C (or its CG) approaches a point in ride 100 above the hub's rotation axis 123. This may be a similar experience as a roller coaster in which the train of cars slowly approaches a high point of the track followed by a quick drop.

Another ride experience or vehicular dynamics zone is shown with vehicle 160D that is supported by lever arm assembly 150D. The lever arms of assembly 150D are shown to be in contact with the forward stop 142 of a stop pair 140 associated with the vehicle 160D, and this would occur after the vehicle 160D and assembly 150D are pitched forward from their contact position with rear stop 144. In other words, as the hub 120 rotates 124, the vehicle assembly 160D is rotated until its CG (including other contributors such as assembly 150D and passengers of vehicle 160D) is directly above the axis 123 (or a similar balancing arrangement). This may be thought of as tipping or balancing point in operation of ride 100 at which the vehicle 160D is no longer (or just slightly) supported by the rear stop 144 and is, instead, supported only from below upon the pivotal connection between the arms of assembly 150D and the rim body 132 (or hub 120, in some embodiments).

Then, incremental additional movement 124 of hub 120 causes the lever arm assembly 150D and vehicle 160D to fall off the back stop 144 toward the front stop 142 under the forces of gravity. This may be a "free" fall (e.g., free forward rotation) or may be controlled using a dampener or using a brake that is controlled by a passenger in vehicle 160D. As the arms of assembly 150D move from back stop 144 to forward stop 142 as shown with arrow 161D (e.g., the arms pivot in the same direction as the hub's rotation 124), the vehicle 160D moves at a velocity that is greater than that of the hub 120, i.e., this free fall velocity is greater than $V_1$ and $V_3$. As shown, once the arms of assembly 150D contact the front stop 142, the vehicle 160D ends its free fall travel (or reaches front/forward end of stop-defined range of travel during a free fall or free swinging movement) and its rate of rotation or velocity, $V_1$, is again that of the hub 120.

During the free fall, the lever arms of assembly 150D pivoted about a pivotal connection to rim 130 such as about pin/axle 270 and such pivoting is about a lever arm axis, $Axis_{Lever\ Arm}$, shown in FIGS. 1 and 2. Additionally, during this free fall, the lever arms of assembly 150 are only supported at this pivotal connection point (i.e., are spaced apart from stops 142, 144) and are supported from below (rather than from above as for assembly 150B), which effects the dynamics experienced by vehicle 160D. The vehicle 160D is free to pivot about its connection to the outer ends of the arms of lever arm assembly 150D with such pivoting shown with arrow 163D about the axis, $Axis_{Vehicle}$. The pivoting 163D may be a full 360 degree rotation about the axis, $Axis_{Vehicle}$, as shown but more often a smaller amount of rotation or swing will be experienced by the vehicle 160D during the travel of the lever arm assembly 150D between the associated stops 142, 144.

Figure 3:
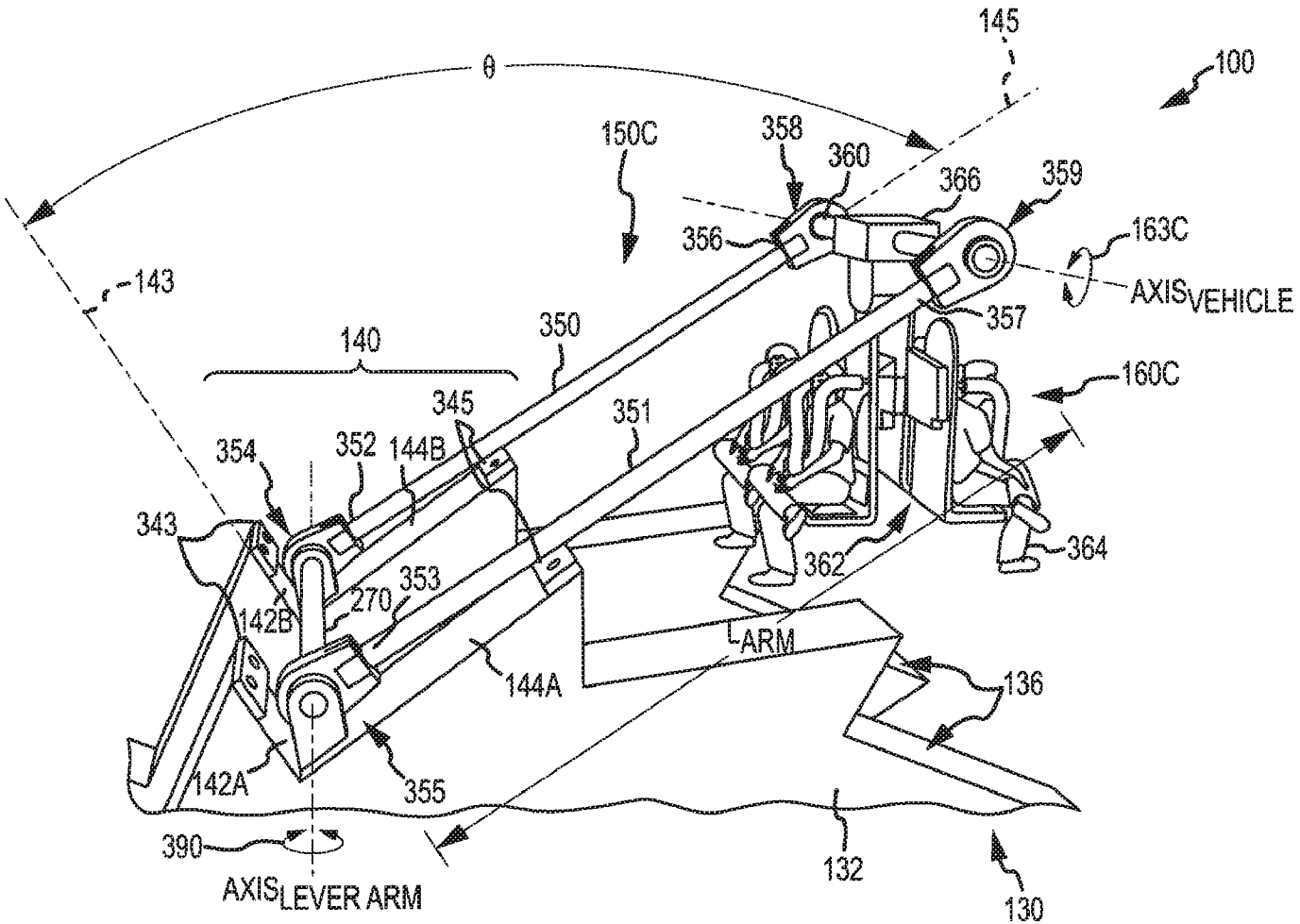
FIG. 3 illustrates a partial perspective view of the rotating wheel ride of FIGS. 1 and 2 showing a single passenger vehicle and lever arm assembly in more detail (e.g., during the back stop-contacting portion of the ride)
Figure 4:
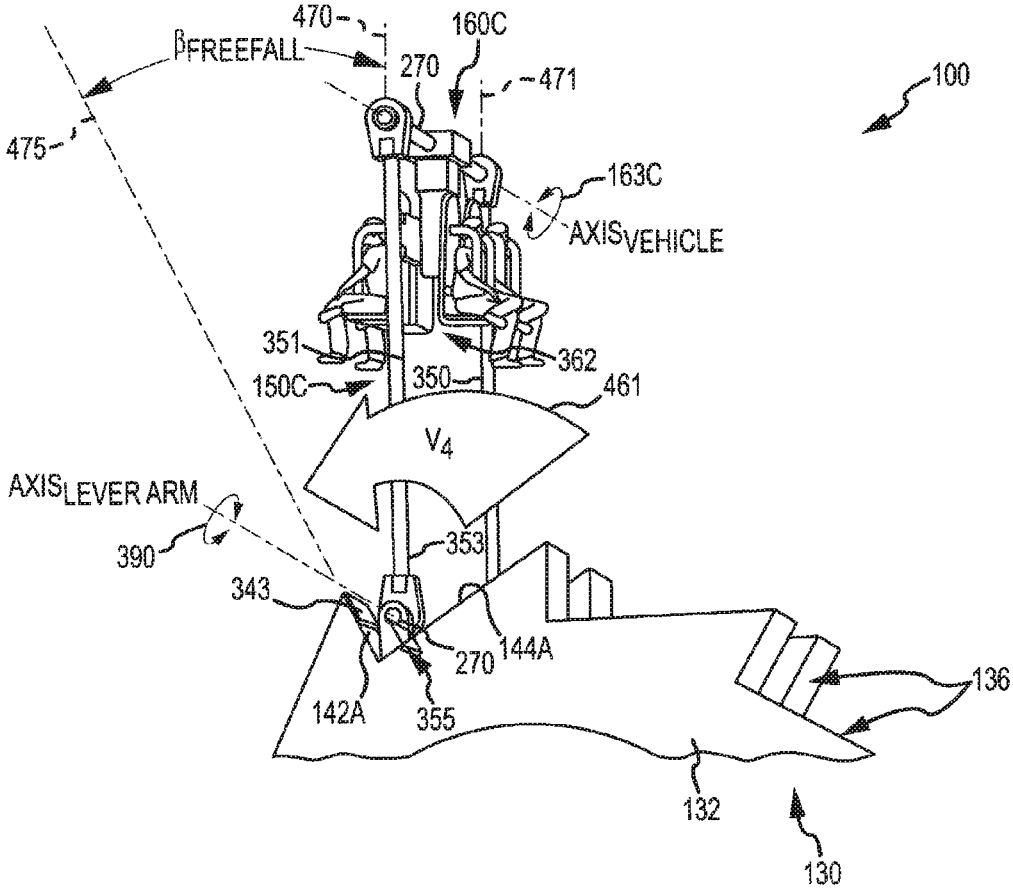
FIG. 4 illustrates a partial perspective view of the rotating wheel ride of FIGS. 1 and 2 showing, similar to FIG. 3, the single passenger vehicle and lever arm assembly in more detail (e.g., during (or immediately before) a free fall (or an upper free swing) portion of the ride in which the lever arm assembly is only pivotally supported from below by the rim and its arms are not contacting either stop)
Figure 5:
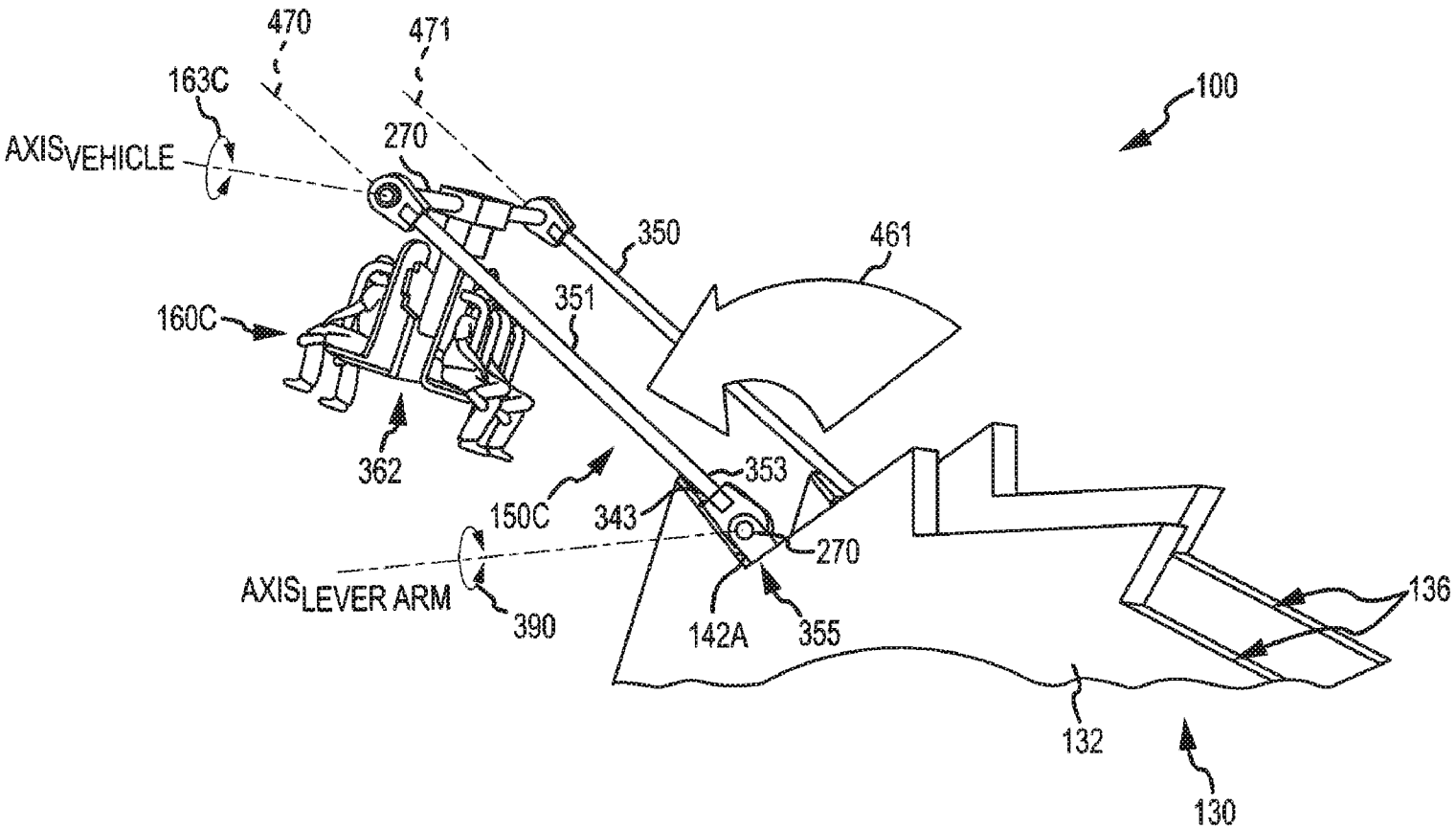
FIG. 5 provides another partial perspective view of the rotating wheel ride of FIGS. 1 and 2 showing, similar to FIGS. 3 and 4, the single passenger vehicle and lever arm assembly in more detail (e.g., at the end of the free fall portion of the ride, which coincides with the beginning of the front stop-contacting portion of the ride)

FIGS. 3 to 5 illustrate in more detail the lever arm assembly 150C and vehicle 160C as the lever arms are moved from contact with the front stop to a free swinging position to contact with the forward stop. In FIG. 3, the lever arm assembly 150C is shown to be rotated to a position in which it abuts and is supported by the rear hard stop(s) 144A, 144B on pads or bumpers 345. The lever arm assembly 150C is shown to include first and second pivot or lever arms 350, 351 that abut pad/bumpers 345 on stops 144A, 144B. The arms 350, 351 have a length, $L_{Arm}$, as measured between pivot points or axes, $Axis_{Lever\ Arm}$ and $Axis_{Vehicle}$. The length, $L_{Arm}$, may be selected from a large range to practice the ride 100 such as 5 to 30 feet or more, with the particular length used tuned or chosen to achieve a desired free falling experience including a maximum vehicle velocity during free fall (e.g., upon impact of arms 350, 351 with forward hard stops 142A, 142B or pads/bumpers 343 on these stops). The arms 350, 351 may take the form of solid and rigid rods (e.g., metal cylinders) or other structural forms to practice the ride 100.

At inner or first ends 352, 353, the arms 350, 351 are coupled to the rim via pivotable connection mechanisms (or pivotal connectors) 354, 355 such that the pivot axis, $Axis_{Lever\ Arm}$, of the arms 350, 352 relative to the rim 130 is between the front and rear stops 142A, 142B and 144A, 144B, respectively (e.g., the connecting points between the stops and the axis, $Axis_{Lever\ Arm}$, are coplanar, for example). The connectors 354, 355 provide a pivot arm mount to the contact surface 136 of rim 130 that includes a freely pivoting connection such as via an axle or shaft 270 that extends between mounting brackets that is free to pivot as shown with arrow 390 about axis, $Axis_{Lever\ Arm}$. As a result, the arms 350, 351 are able to pivot or rotate 390 through the angle, θ, between the front stops 142A, 142B and rear stops 144A, 144B (as shown by axes 143, 145), which may be up to 90 degrees or more.

At outer or second ends 356, 357, the arms 350, 351 provide connectors or coupling mechanisms 358, 359 for pivotally supporting axle or rod 360. The vehicle 160C includes a seating structure or body 362 for seating one to four or more passengers 364. The body 362 is rigidly mounted via mounting bracket 366 to the axle or rod 360 such that the body 362 and its passengers 364 may freely pivot about a center axis, $Axis_{Vehicle}$, of the axle or rod 360 during rotation of the rim 130 about a ride's center rotation axis. Unless the passengers 364 are rocking the body 362, the body 362 of vehicle 160C may generally pivot as shown with arrow 163C in response to gravity such that the body 362 remains in a lower or "horizontal" position (shown in FIG. 3) when the arms 350, 351 are traveling with the rim 130 on back stops 144A, 144B.

FIG. 4 illustrates the ride as the vehicle 160C is being pitched forward into a free fall or free swing as shown by arrow 461. In some cases, the arms 350, 351 will lift off or away from the rear stops 144A, 144B as the vehicle 160C (and other contributing factors) has its CG directly over center of rotation of the rim 130 (or hub 120 not shown in FIG. 4). For example, the arm axes 470, 471 may extend through the hub's center axis or axis of rotation (i.e., be coplanar with this axis) at the tipping point. However, the lift off or pitch forward location may vary depending on a number of factors such as the design of rear stops 144A, 144B and arms 350, 351 (e.g., if these are not simply linear rods but take a curved, a bent, or other shape).

When the rim 130 is further rotated past the tipping point shown in FIG. 4, the arms 350, 351 along with the pivotally supported vehicle 160C may sweep or fall 461 through a range of motion defined by the location or configuration of the front or receiving stops 142A, 142B as the arms 350, 351 pivot 390 about the axis, $Axis_{Lever\ Arm}$, passing through pivotal connections 354, 355. Typically, the velocity, $V_4$, of the vehicle 160C through this free fall motion is significantly faster than the velocity of the hub rotation such that the passengers 364 experience a free falling sensation through the rotation range or angle, $\beta_{Freefall}$, which is typically the same or less as the range of motion between the stops (as shown as angle, θ, in FIG. 3). Also, as discussed above, the free falling 461 is in the same direction as the rotation of rim 130 such that the vehicle 160C travels faster in this zone of the ride 100.

FIG. 4 is useful for showing that during freefall 461 the arms 350, 351 are spaced apart from stops 142, 144 and the lever arms 350, 351 are supported from below by pivotal connectors 354, 355, which provides a unique ride experience or dynamic movement of vehicle 160C not found in conventional Ferris wheels as, in addition to a freefall, there is a sensation of momentarily balancing on a pivot point before falling rapidly downward until the arms 350, 351 strike the forward or receiving stops 142A, 142B. Such a transition in vehicular dynamics is shown in FIG. 5 as the free falling or swinging 461 is terminated as the arms 350, 351 rotate 390 about axis, $Axis_{Lever\ Arm}$, until the arms 350, 351 strike pads/bumpers 342 on stops 142A, 142B. During and after this rapid falling movement, the thrill of ride 100 is also increased by a more dramatic swinging 163C of the vehicle body 362 with passengers 364 about the vehicle's rotation axis, $Axis_{vehicle}$, such as through 180 degrees or more in some cases. The vehicle 160C rapidly slows down when it reached the position shown in FIG. 5 such that it again travels at the same rate as the hub and attached rim 130.

Figure 6:
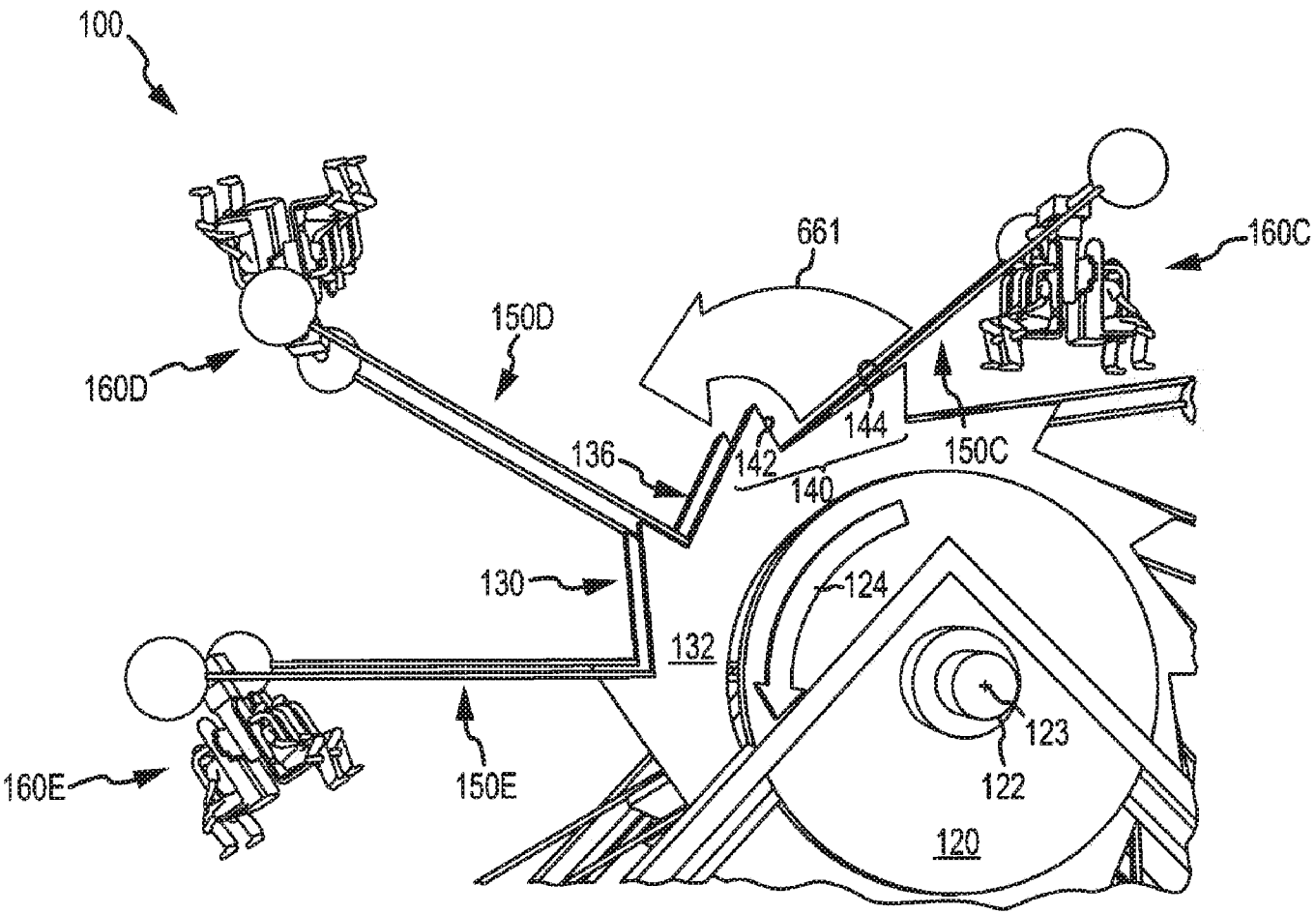
FIG. 6 is a partial side of the ride similar to FIGS. 3-5 three adjacent lever arm assembly and vehicle combinations as they are rotated through the free swing/fall portion of the ride.

The vehicle movements shown in FIGS. 3-5 are reviewed or summarized in FIG. 6. This illustration shows a vehicle 160C rotating with the hub 120 at its rotation rate 124 because the pivot arms of assembly 150C are resting on or abutting rear stops 144 of the associated stop pair 140. Once rotation 124 of hub 120 causes the vehicle 160C to have its CG above rotation axis 123 (or another tipping/upper balancing location), the pivot arms of assembly 150C are pitched forward or free fall 661 in the direction of hub rotation 124 but at faster velocity or rotation rate toward forward or receiving stop 142 of rim contact surface 136. Vehicle 160D which is pivotally supported by arm assembly 150D is shown to be transitioning from rear stops 144 to front stops 142, with the vehicle 160D shown to have fully rotated about its pivotal connection to the arm assembly 150D (although in many case rotation would not be this dramatic or to this large of an extent). The vehicle 160E supported by arm assembly 150E is traveling with the hub 120 at the rotation rate 124 of the hub 120 as its pivot or lever arms of assembly 150E are resting against front or receiving stops 142 of the corresponding stop assembly or pair 140 on contact surface 136 of the rim body 132. The vehicle 160E may be swinging or oscillating on the ends of lever arms of assembly 150E to a relatively large extent as the kinetic energy imparted by the free fall to stop 142 is expended or absorbed by vehicle 160E.

As shown in FIG. 1-6, the rotating wheel rides described herein include vehicles that are pivotally attached to a vertical center hub through a freely pivoting lever arm(s) (or pivot arm(s)). During operation of the ride, the center hub may be constantly rotating at a particular rotation rate or speed (e.g., typically very low revolutions per minute equivalent to traditional Ferris wheel attractions). The lever arm(s) pivotally supports the vehicle at one end and is pivotally connected at the other end to the rim of the wheel/hub or directly to the wheel. Rotational range or travel of the lever arm(s) is limited such that the arm(s) pivots within a rotational range defined by front and back or rear stops.

For example, the ride may be configured such that as each vehicle's CG passes over the center of hub rotation (or center axis of the hub), the lever arm(s) rotates forward (e.g., in the direction of hub rotation) causing the vehicle to "fall" until the lever arm(s) contacts the front stop(s). The dynamics of this move are highly tunable based on distance between stops (which may be measured by an angle between the planes/axes containing the contact surfaces of the front and rear stops), length of the pivot arm(s), speed of rotation of the hub, and any rotational damping or braking provided for the lever arm(s) at or associated with the pivotal connection to the rim/hub and/or at the vehicle to lever arm connection.

Figure 7:
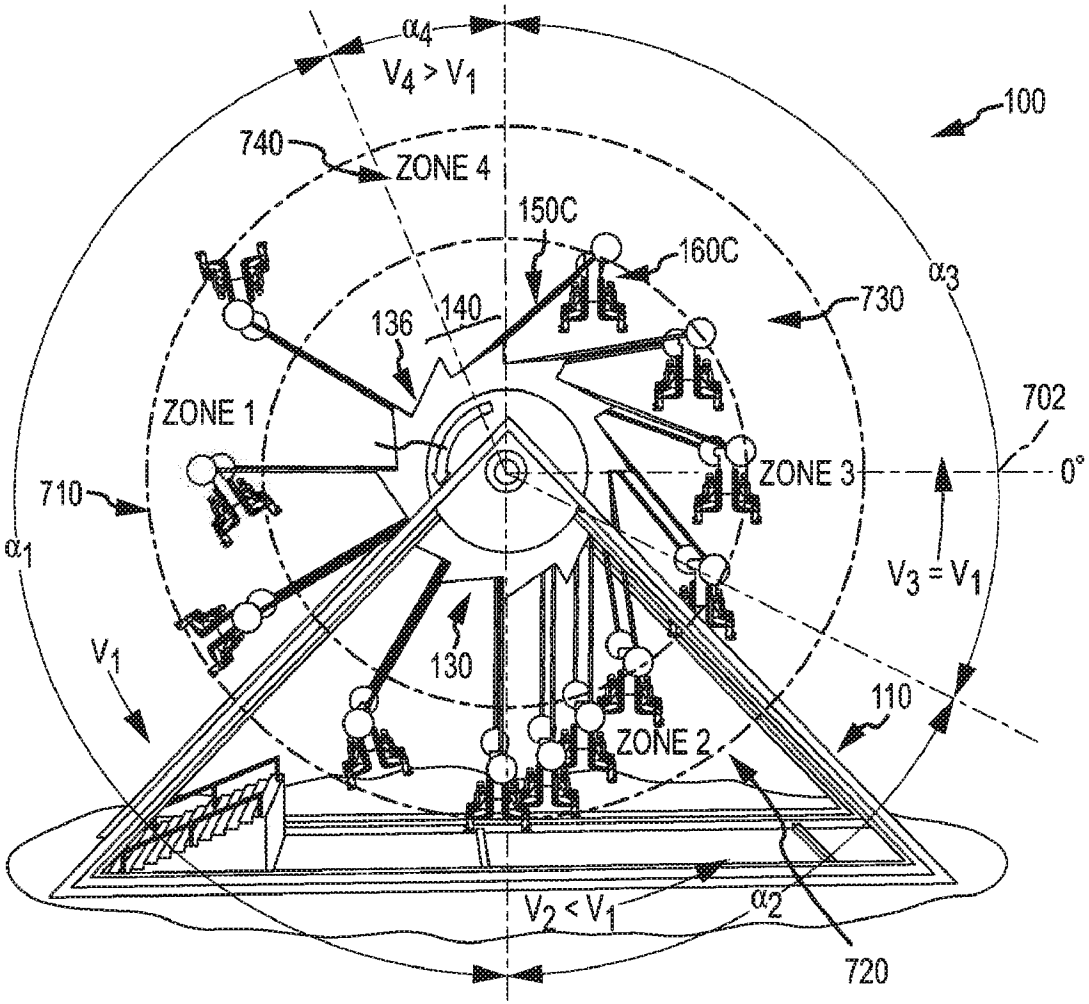
FIG. 7 is a side view of the rotating wheel ride similar to FIG. 1 but with an overlay showing the four vehicle-dynamics zones of the ride (e.g., a front stop-contacting zone (vehicle moves with hub at speed of hub), a first free swinging (or hanging, vertical lift, or the like) zone in which the lever arm assembly is only supported from above by the rim and its lever arms are spaced apart from both stops, a back stop-contacting zone (vehicle moves with hub at speed of hub), and a second free swinging or falling zone in which the lever arm assembly is only pivotally supported from below by the rim with its lever arms spaced apart from both stops.

At this point, it may be useful to discuss operations of the ride 100 and how it is configured to provide four ride experiences or four zones of differing vehicular dynamics (e.g., velocity, vertical falling, vertical lifting, and the like). FIG. 7 illustrates the ride 100 with schematics or overlays showing four operating or ride experience zones of the ride that are provided by the combined use of the lever/pivot arm-mounting of the vehicles with a contact surface providing spaced-apart pairs of stops defining travel ranges for the pivoting lever arms. Specifically, FIG. 7 shows that the ride 100 is configured to include first, second, third, and fourth zones 710, 720, 730, and 740, respectively, through which each of the vehicles travels during each rotation 124 of the hub or wheel 120.

In the first zone 710, the lever arms (which pivotally couple a vehicle to hub 120 or rim 130) are positioned against the first or front stop of a stop pair associated with a vehicle. In this zone 710, the lever arms and coupled vehicle rotate with the center hub 120 in the same direction and at the same speed (e.g., the center hub speed or rotation rate about center rotation axis 123) or at $V_1$. The first zone 710 may be relatively large, as shown, and may be defined by an angular rotation range, $\alpha_1$, such as 90 to 180 degrees (or one quarter to one half) of each rotation of the hub or each ride rotation (or ride cycle). In the illustrated ride with its configuration of stop pairs (which may partially define the size and location of the various zones), the first zone 710 makes up about 150 degrees of each 360 degrees of rotation of the hub 120, begins at about 120 degrees (when 0 degrees is in a horizontal plane extending through axis 123 and to the right of axis 123 when viewing the page containing FIG. 7 shown with plane 702 and with counter clockwise rotation 124 of hub 120 when the ride 100 is viewed from the side shown in FIG. 7), and ends at about 270 degrees or directly below the axis 123.

As the wheel 120 rotates 124 further, each vehicle is positioned into a second zone 720, and the transition point or starting point of the zone 720 is typically at a location (based on the configuration of the stops, lever arm, and the like) where the vehicle is fully supported, from above, via the lever arms pivotal connection to the hub 120 or rim 130. In some cases, this may be where the CG of the vehicle is directly below the center rotation axis 123 (as shown in FIG. 7). In other words, in the second zone 720, the pivot arm is spaced apart from both the front and back stops. As a result, the vehicle rotates more slowly than the center hub 120, i.e., $V_2$ is less than $V_1$ (or the hub's rotation rate). The passengers in the vehicles traveling through the second zone 720 experience a vertical lifting sensation with additional rotation of the hub 120. Typically, the second zone 720 is much smaller than the first zone 710, and its angular range may be less than about 90 degrees, e.g., $\alpha_2$ shown in FIG. 7 may be less than one quarter of a rotation of hub 120 at 50 to 70 degrees or the like.

The third zone 730 ends at a point in the hub travel 124 in which the lever arms begin to fall away from the rear stop. The end of the third zone 730 (and start of fourth zone 740) may also be thought of as the point in which the CG of the pivoting arm and vehicle assembly is directly above the center of rotation 123 of the hub 120. As shown, the size of the third zone 730 may be defined by angular rotation range, $\alpha_3$, which may be greater than about 90 degrees such as between 90 and about 130 degrees thought this may depend entirely on the angle between stops. The described implementation results in the third zone 730 making up one quarter to about one third or more of each rotation of the hub 120 about axis 123.

The third zone 730 begins at the point in the rotation of hub 120 that the lever arms pivotally supporting a vehicle come into contact with a rear or second stop of the stop pair associated with the vehicle. This may occur as shown at about 330 to 360 degrees of each 360 degree rotation of hub 120 (e.g., at some point between three quarters to a full rotation of hub 120 when the rotation is considered to start at 0 degrees in plane 702 shown in FIG. 7). The specific starting point of zone 730 (as with the other zones) may vary with the spacing and shape of stops as well as the design of the vehicle, lever arms, and passenger positioning/weight in the vehicle. In the third zone 730, the pivot arm is against the rear or second stop, and, as a result, the lever arms and pivotally supported vehicle rotate with the hub 120 in the same direction and at the same speed (i.e., $V_3$ equals $V_1$, which, as explained above, is the hub rotation rate/speed). Hence, the third zone 730 provides a Ferris wheel-type ride experience, but it differs because of this zone 730 is used to build up anticipation of an upcoming thrill via a free fall or swing.

The free fall or free swinging experience is provided in the fourth zone 740. The fourth zone 740, as discussed above, begins when the vehicle is balancing solely upon the lever arms and their pivotal connection to the hub 120 or rim 130 (e.g., the vehicle is supported solely from below and is again spaced apart from both stops of its associated/corresponding stop pair). The balancing or tipping point, of course, is only momentary as further rotation of the hub 120 and rim 130 causes the lever arms and their pivotal connections to the rim 130 to change. This causes the vehicle to fall vertically downward or to pitch forward on the pivot point of the lever arms-to-rim/hub connection providing a free fall sensation to the passengers. The vehicular dynamics in the fourth zone 740 differ from the other zones as the vehicle is rotating in the same direction but faster than the center hub 120 (i.e., $V_4$ is greater than $V_1$).

The size of the fourth zone 740 may be defined by angular rotation or travel, $\alpha_4$. The magnitude or size of zone 740 may be varied to practice the ride 100 but typically will be less than one quarter rotation of hub 120 such as less than about one eighth of a rotation of hub 120 (e.g., $\alpha_4$ may be less than 45 degrees or in the range of 0 to about 35 degrees or the like). The size, $\alpha_4$, may be selected to achieve a desired maximum vehicle velocity, $V_4$, with greater ranges or sizes, $\alpha_4$, being used to achieve increased vehicle velocities, $V_4$. Again, dampeners, throttles, passenger-controlled brakes, and other devices may be used to reduce or control the velocity of the vehicle from such a maximum achievable rate set by ride parameters such as spacing between stops and the like.

As described, the rotating wheel ride embodiments provide a new and unique experience for passengers when compared to conventional Ferris wheels. The ride experiences or vehicular dynamics include a vertical lift, a Ferris wheel-type sensation, and a pitching and free fall motion that are all combined into a single relatively simple to build and maintain ride. The rotating ride has the ability to provide high thrill with increasing anticipation as the vehicle's CG approaches a tipping point over the hub center of rotation and then free falls forward (or backward if the hub is rotated in the opposite direction). This may result in dynamic rotation of the passenger seating structure.

The amount of thrill and/or vehicular dynamics may be tuned to suit a particular application. For example, the ride may be made more or less thrilling (e.g., less free fall range, lower vehicle rotation rates, and so on) by adjusting arm length (longer lengths typically increasing vehicle rotation rates and other dynamic sensations), by changing stop locations (e.g., reduce amount of rotation or angular travel to limit vehicle velocity, contact force when striking front stop, and so on), and damping/braking on the arm and/or the vehicle pivots. Interactivity may be provided by incorporating a passenger-controlled brake (e.g., a foot pedal, a hand operated lever/switch, or the like on the vehicle body that operates a damper, a brake, a throttle, a clutch, or other mechanism proximate to the pivotal connections) and allowing the passengers to control the speed of lever arm motion as the lever arm rotates between front and back stops or vehicle swinging rate/range on the end of the lever arm.

We claim:

1. A rotating wheel ride, comprising:

a vertical wheel driven to rotate about a central rotation axis;

a plurality of passenger vehicles; and a lever arm assembly associated with each of the passenger vehicles, the lever arm assembly pivotally connected at a first end to the wheel and at a second end to the associated passenger vehicle, wherein the wheel includes, for each of the passenger vehicles, a front stop and a rear stop spaced apart from the front stop and wherein each of the lever arm assemblies is positioned on the wheel to pivot during a rotation of the vertical wheel between a first contact with the front stop to a second contact with the rear stop.

2. A rotating wheel ride, comprising:

a vertical wheel driven to rotate about a central rotation axis;

a plurality of passenger vehicles; and a lever arm assembly associated with each of the passenger vehicles, the lever arm assembly pivotally connected at a first end to the wheel and at a second end to the associated passenger vehicle, wherein each of the lever arm assemblies includes at least one lever arm pivotally coupled to the wheel and to the associated passenger vehicle, whereby the associated passenger vehicle is pivotally supported by the lever arm, and wherein each of the lever arms extends outward from the wheel between a pair of the front and rear stops to the associated passenger vehicle.

3. The rotating wheel ride of claim 2, wherein the wheel includes a rim with a contact surface providing the pairs of front and rear stops.

4. The rotating wheel ride of claim 3, wherein each of the pairs of front and rear stops are configured to define an angular travel range for one of the lever arms.

5. The rotating wheel ride of claim 4, wherein the angular travel range is selected from the range of about 15 degrees to about 110 degrees and wherein each of the lever arms has a length measured between a pivotal connection on the wheel and a pivotal connection to the associated passenger vehicle that is at least about 8 feet.

6. A Ferris wheel-type ride, comprising:

a vertically orientated hub adapted for being rotated about a central axis;

a plurality of vehicles;

a lever arm associated with each of the vehicles, the lever arm pivotally coupled to the hub at a first end and to the associated vehicle at a second end, whereby the lever arm pivots at the first end and the associated vehicle pivots about the second end during rotation of the hub about the central axis; and for each of the lever arms, a pair of stops defining a range of travel for the lever arm between a first and second stop as the lever arm pivots about the first end.

7. The ride of claim 6, wherein the range of travel is greater than about 15 degrees.

8. The ride of claim 6, wherein the hub includes a rim providing a contact surface defining the stops and wherein each of the lever arm is pivotally connected to the rim between one of the pairs of stops.

9. The ride of claim 8, wherein each of the lever arms pivots between one of four positions during the rotation of hub, the four positions include a first zone position with the lever arm in contact with the first stop, a second zone position with the lever arm spaced apart from the stops and the lever arm supported from above by the rim, a third zone position with the lever arm in contact with the second stop, and a fourth zone position with the lever arm spaced apart from the stops and the lever arm supported from below by the rim.

10. The ride of claim 9, wherein, in the fourth zone position, the lever arm free falls, under gravitation forces acting upon the lever arm and the associated vehicle, toward the first stop and in a direction of the rotation of the hub such that the associated vehicle moves at a velocity exceeding a rotation rate of the hub about the central axis.

11. The ride of claim 6, wherein a second lever arm is associated with each of the vehicles and is spaced apart from the other lever arm associated with the vehicle to pivot at a first end on the hub and to pivotally support the associated vehicle at a second end via a shaft extending to the second end of the other lever arm, whereby the associated vehicle pivots between the lever arms during rotation of the hub about the central axis.

12. The ride of claim 6, further comprising a user input device in each of the vehicles and a rotation limiting mechanism resisting the pivoting of the lever arm during rotation of the hub in response to input received from the user input device.

13. A ride, comprising:

a vertical wheel rotating at a huh rotation rate during operation of the ride;

pairs of spaced apart stops providing a contact surface on, the wheel;

a lever arm assembly associated with each of the stop pairs and mounted to the wheel to pivot between a front stop and a rear stop in the associated stop pair during the operation of the ride; and a passenger gondola pivotally attached to each of the lever arm assemblies at a location spaced apart from the contact surface, wherein each of the passenger gondolas sequentially travel through at least a first and a second vehicular dynamics zones in which the passenger gondolas have differing ride dynamics.

14. The ride of claim 13, wherein in the first vehicular dynamics zone a portion of the lever arm assembly abuts the front stop and in the second vehicular dynamics zone the lever arm is spaced apart from the stops and the lever arm assembly is supported from above by the wheel via a pivotal connection mechanism.

15. The ride of claim 14, wherein each of the passenger gondolas further sequentially travels through at least a third and a fourth vehicular dynamics zone and wherein in the third vehicular dynamics zone a portion of the lever arm assembly abuts the rear stop and in the fourth vehicular dynamics zone the lever arm assembly is spaced apart from the stops and the lever arm assembly is supported from below by the wheel on the pivotal connection mechanism and is able to rotate about this connection.

16. The ride of claim 15, wherein the lever arm assemblies are vertically supported by the front and rear stops, respectively, when the associated passenger gondola is in the first and third vehicular dynamics zones, whereby the passenger gondola associated with each of the lever arm assemblies has a velocity of about the hub rotation rate in the first and third vehicular dynamics zones.

17. The ride of claim 15, wherein the lever arm assemblies pivot in a direction opposite of rotation of the wheel in the second vehicular dynamics zone, whereby the passenger gondola associated with each of the lever arm assemblies has a velocity of less than the hub rotation rate and is vertically lifted in the second vehicular dynamics zone.

18. The ride of claim 15, wherein the lever arm assemblies pivot in a direction coinciding with rotation of the wheel in the fourth vehicular dynamics zone, whereby the passenger gondola associated with each of the lever arm assemblies has a velocity greater than the hub rotation rate in the fourth vehicular dynamics zone.

* * * * *

UNITED STATES PATENT AND TRADEMARK OFFICE

CERTIFICATE OF CORRECTION

PATENT NO. : 8,337,317 B2
APPLICATION NO. : 12/883834
DATED : December 25, 2012
INVENTOR(S) : David W. Crawford and Edward A. Nemeth It is certified that error appears in the above-identified patent and that said Letters Patent is hereby corrected as shown below:

Col. 15 Line 29 - Col. 16 Line 4 please replace Claim 13 with the following rewritten claim:

-- A ride, comprising:
a vertical wheel rotating at a hub rotation rate during operation of the ride;
pairs of spaced apart stops providing a contact surface on, the wheel;
a lever arm assembly associated with each of the stop pairs and mounted to the wheel to pivot between a front stop and a rear stop in the associated stop pair during the operation ride; and
a passenger gondola pivotally attached to each of the lever arm assemblies a location spaced apart from the contact surface,
wherein each of the passenger gondolas sequentially travel through at least a first and a second vehicular dynamics zones in which the passenger gondolas have differing ride dynamics. --

Signed and Sealed this
Nineteenth Day of February, 2013

Teresa Stanek Rea
*Acting Director of the United States Patent and Trademark Office*